United States Patent [19]

Hauser et al.

[11] 4,395,471

[45] Jul. 26, 1983

[54] BLENDED TONERS OF FUNCTIONAL COLOR

[75] Inventors: Oscar G. Hauser, Rochester; Frederick R. Ruckdeschel, Webster, both of N.Y.

[73] Assignee: Xerox Corporation, Stamford, Conn.

[21] Appl. No.: 366,946

[22] Filed: Apr. 9, 1982

Related U.S. Application Data

[63] Continuation of Ser. No. 212,789, Dec. 4, 1980, abandoned, which is a continuation of Ser. No. 80,625, Oct. 1, 1979, abandoned.

[51] Int. Cl.[3] ..... G03G 9/10; G03G 13/08

[52] U.S. Cl. ..... 430/45; 430/108; 430/109

[58] Field of Search ..... 430/45, 108, 109

[56] References Cited

U.S. PATENT DOCUMENTS 3,847,604 11/1974 Hagenbach ..... 430/107

4,066,563 4/1978 Mammino et al. ..... 430/108

*Primary Examiner*—John E. Kittle

*Assistant Examiner*—John L. Goodrow

*Attorney, Agent, or Firm*—E. O. Palazzo

[57] ABSTRACT

This invention is directed to a developer composition comprised of a resin, a colorant such as cyan, magenta, yellow, or mixtures thereof, and a single carrier. In one embodiment there is combined with a single carrier material, such as a steel carrier or a nickel berry carrier, a cyan toner, such as a styrene/n-butyl methacrylate resin, and copper tetra-4-(octadecylsulfonomido) phthalocyanine, a magenta toner material comprised of styrene/n-butyl methacrylate copolymer resin and 2,9-dimethyl substituted quinacridone, and/or a yellow toner material comprised of styrene/n-butylmethacrylate copolymer resin and a diaryldide yellow 3,3-dichlorobenzidene aceto acetanilide. The developer composition is useful for developing color images in an electrophotographic imaging system. In this system a photoreceptor material contained therein is charged, imagewise exposed, followed by development, transfer of the developed image to a suitable substrate such as paper, and permanently fixing the developed image, by heat for example, to the substrate.

11 Claims, No Drawings

BLENDED TONERS OF FUNCTIONAL COLOR

This is a continuation, of application Ser. No. 212,789, filed Dec. 4, 1980 now abandoned which is a continuation of application Ser. No. 080,625 filed Oct. 1, 1979 now abandoned.

BACKGROUND OF THE INVENTION

This invention relates generally to color electrophotography, and more specifically to the use of a series of toners which are prepared by blending different amounts of the subtractive primary toners in order to obtain a choice of colors using a single pass electrophotographic system, preferably a xerographic system.

The formation and development of images in an electrophotographic system, and more specifically a xerographic system is well known as described, for example, in U.S. Pat. No. 2,297,691. In such systems, several methods are used for applying the electroscopic particles or toner to the latent electrostatic image to be developed, such methods including cascade development, U.S. Pat. No. 2,618,552; magnetic brush development, U.S. Pat. No. 2,874,063; powder cloud development, U.S. Pat. No. 2,221,776; touchdown development, U.S. Pat. No. 3,166,432 and the like. Generally, the toners used in these types of systems result in the production of black images.

Recently there has been developed processes and materials for use in the formation of color images. Electrophotographic color systems are generally based on trichromatic color synthesis, such as the substractive color formation types. Accordingly, in electrophotographic color systems, toner or developing particles of at least three different colors are employed to synthesize any desired color. Generally, at least three color separation images are formed and the combined images register with each other to form a colored reproduction of a full colored original. In color xerography as described, for example, in Dessauer U.S. Pat. No. 2,962,374, at least three latent electrostatic images are formed by exposing a xerographic plate to different optical color separation images. Each of the latent electrostatic images is developed with a different color toner and subsequently the three toner images are combined to form the final full color image. This combination of three color toner images is generally made on a copy sheet such as paper to which the toner images are permanently affixed. One of the most common techniques for fixing these toner images to the paper copy sheet is by employing a resin toner which includes a colorant, and heat fixing the toner images to this copy sheet. Images may also be fixed by other techniques such as, for example, subjecting them to a solvent vapor.

In one known process an electrostatic latent image is exposed through a green filter to an imagewise projection of a color image to form an electrostatic latent image on the photoreceptor. This electrostatic latent image is then developed with the complimentary magenta color toner to form a magenta colored image corresponding to said electrostatic latent image and transferred in register to an image receiving member. The photoreceptor is then electrostatically charged uniformly in the dark and exposed through a red filter to an imagewise projection of a color image in register with said magenta developed image to form a second electrostatic latent image which second image is developed with the complimentary cyan-colored toner and likewise transferred in register. The photoconductor is again electrostatically uniformly charged in the dark and then exposed through a blue filter to an imagewise projection of a color image in register with said magenta and cyan developed images to form a third electrostatic latent image which is then developed with the complimentary yellow toner and again transferred in register. The sequence of exposures through colored filters in this multiple development process may be performed in any suitable sequence other than the green, red and blue mentioned.

In these systems one important aspect resides in registration of the color toner image on the copy sheet, that is, the cyan, magenta, and yellow image should be in registration on the receiving member.

Generally, each developer used comprises a toner or resin colored mixture in combination with an appropriate carrier. The toners used must possess the appropriate color and continue to function under machine conditions which expose the developer to impaction and humidity among other undesirable factors. A three color system that has been well known and used in the past includes pigments of suitable cyan, magenta and yellow materials. One of the problems associated with the prior art processes is that it is necessary to use multiple passes, that is, three steps in development with three different colors, which can become cumbersome, uneconomical and slow. Other disadvantages of the prior art processes include the requirements that, (1) the photoreceptor be panchromatic, (2) the development response of each of the three toner developers be constant with usage, and (3) the transfer of the three different developed images be constant.

Also it is known in the prior art that the three color layers can be coated one on top of the other, the first layer being the magenta layer, the second being the cyan layer and the third being the yellow layer. Each subtractive color transmits two thirds of the spectrum and absorbs one third. The combination of cyan, magenta and yellow layers appears black, while the combination of magenta and yellow layers appears red, the combination of magenta and cyan layers appears blue and the combination of yellow and cyan layers appears green.

SUMMARY OF THE INVENTION

It is therefore an object of this invention to provide an electrophotographic color system which overcomes the above noted disadvantages.

Another object of the present invention is to provide a combination of color toner materials which produce high quality single color images in an electrophotographic imaging process; especially for use with flat color imaging.

Another object of the present invention is the provision of a series of toners which are prepared by blending different amounts of subtractive primary toners which toners can be used to develop images of a variety of single colors using a single pass xerographic imaging system. The use of a single pass system eliminates the requirement for precise registration of the transferred toner images.

A further object of the present invention is to provide a variety of color toners which can be used with a single carrier material, thus providing developers which are very compatible.

Another object of the present invention is the provision of a wide variety of colors which are very practical and economical to use, it being more practical for example to blend the toners, than to prepare a substantial number of different individual color toners.

These and other objects of the present invention are accomplished by providing a developer composition comprised of a resin, colorant or pigment, and a single carrier. Generally there is combined with the single carrier an appropriate blend of toners comprised of a cyan toner (resin and a cyan colorant or pigment), a magenta toner, and/or a yellow toner and mixtures thereof. Various different blended toner combinations can be used as more fully illustrated hereinafter. By toner in this context is meant a combination of resin and colorant or pigment. In one preferred embodiment the toners are blended by complete mixing, and a portion of the resultant mixture is then combined with the single carrier material.

The amounts of ingredients used in the blended toner can vary substantially, such amounts depending on the shade of color desired. Essentially thus any quantity, including the same amounts, or different amounts of cyan, magenta, and yellow materials can be used depending on the shade of color desired. Accordingly, while there is no real preference as to the amounts of colorants used illustrative examples include the following:

| Approximate Desired Color Shade | Parts of Cyan By Weight | Parts of Magenta By Weight | Parts of Yellow By Weight |
|---|---|---|---|
| 1. Yellowish Green | 1 | 0 | 7 |
| 2. Orange | 0 | 1 | 7 |
| 3. Green | 1 | 0 | 2 |
| 4. Blue Green | 2 | 0 | 1 |
| 5. Chocolate Brown | 1 | 2 | 2 |
| 6. Red | 0 | 1 | 1 |
| 7. Blue | 3 | 1 | 0 |
| 8. Red | 0 | 2 | 1 |
| 9. Orange (Light) | 0 | 1 | 2 |
| 10. Blue | 1 | 1 | 0 |

The percentage of pigment, or colorant, and resin present in the toner can vary depending on many factors including the shade of toner desired, generally, however, from about 1 percent to about 20 percent by weight, and preferably 5 to 12 percent by weight of colorant is present, and from about 80 percent to about 99 percent by weight, and preferably from 88 percent to 95 percent by weight of resin is present. It is not intended to be limited to the above amounts as greater and lesser amounts of colorants can be used such amounts effecting only the shade of color to be obtained.

The appropriate amounts of cyan, magenta, and yellow toners can be combined by any suitable method including for example simple known mixing and stirring methods. One specific method employed for combining these materials involves the use of a twin shell mixing-blending apparatus at rotation rates of from about 30 to about 60 revolutions per minute, followed by filtering the resultant blend using a 44 micron sieve for the purpose of eliminating agglomerates. It is important to note that the method by which the materials are blended is not critical, however though complete mixing is desired so as to result in the production of a homogenous mixture. In addition to twin shell mixing other types of mixing methods may be employed, including for example paint shaker mixing; Mumson mixing and the like.

Illustrative examples of magenta materials which may be used in the toner package include 2,9-dimethyl substituted quinacridone, an anthraquinone dye identified in the Colour Index as CI 60710, CI Dispersed Red 15, a diazo dye identified in the Colour Index as CI 26050, CI Solvent Red 19, and the like.

Illustrative examples of cyan materials that may be used in the toner package include copper tetra-4-(octadecylsulfonomido)phthalocyanine, an X-copper phthalocyanine pigment listed in the Colour Index as CI 74160, CI Pigment Blue 15, an indanthrene blue identified in the Colour Index as CI 69810, Special Blue X-2137, and the like.

Illustrative examples of yellow materials that may be used in the toner package diarylide yellow 3,3-dichlorobenzidene acetoacetanilide, a monoazo dye identified in the Colour Index as CI 12700, CI Solvent Yellow 16, a nitrophenylaminesulfonamide identified in the Colour Index as Foron Yellow SE-GLF, CI Dispersed Yellow 33, and the like.

Several single suitable carrier materials can be employed including but not limited to sodium chloride, ammonium chloride, granular zinc, silicon dioxide, methyl methacrylate nickel, glass, steel, iron ferrite and the like. Coated carrier materials may also be used, including for example the above mentioned carriers coated with organic maerials such as fluorinated polymes, including polyvinylidene fluoride. Many of the carriers that can be use are described in U.S. Pat. Nos. 2,618,441, 2,638,416, 3,591,503, 3,533,835, and 3,526,533. Also nickel berry carriers as described in U.S. Pat. Nos. 3,847,604 and 3,767,598 can be employed, these carriers being nodular carrier beads of nickel characterized by surfaces of recurring recesses and protrusions providing particles with a relatively large external area. It is important that the carrier that is selected establishes the appropriate triboelectric relationship with the resin that is used, which resin is described in detail hereinafter, in order to enable it to function effectively in an electrophotographic imaging mode. Generally, the carrier ranges in size from about 35 microns in diameter to about 250 microns and preferably from about 80 microns to about 150 microns. The amount of carrier present can vary depending on many factors, including for example the mass density of the carrier; generally, however, about 0.5 percent to about 5 percent, by weight and preferably 1 percent to 3 percent, by weight of carrier is present in the developer mixture.

The blended cyan, magenta, and yellow materials may be combined with any suitable electrophotographic resin including but not limited to thermoplastics like olefin polymers such as polyethylene and polypropylene; polymers derived from dienes such as polybutadiene, polyisobutylene, and polychloroprene; vinyl and vinylidene polymers such as polystyrene, styrene butylmethacrylate copolymers, styrene-acrylonitrile copolymers, acrylonitril-butadiene styrene terpolymers, polymethylmethacrylate, polyacrylates, polyvinyl alcohol, polyvinyl chloride polyvinyl carbazole, polyvinyl ethers, and polyvinyl ketones, fluorocarbon polymers such as polytetrafluoroethylene and polyvinylidene fluoride; heterochain thermoplastics such as polyamides, polyester, polyurethanes, polypeptides, casein, polyglycols, polysulfides, and polycarbonates; and cellulosic copolymers such as regenerated cellulone, cellulose acetate and cellulose nitrate. Generally resins containing a relatively high percentage of styrene are preferred, such as homopolymers of styrene or styrene homologs of copolymers of styrene, with other monomeric groups containing a single methylene group attached to a carbon atom by a double bond.

Any suitable inorganic or organic photoconductor may be used in the present invention. Typical inorganic photoconductor materials include but are not limited to sulfur, selenium, zinc sulfide, zinc oxide, zinc cadmium sulfide, zinc magnesium oxide, cadmium selenide, zinc silicate, calcium-strontium sulfide, cadmium sulfide indium trisulfide, gallium triselenide, arsenic disulfide, arsenic trisulfide, arsenic triselenide, antimony trisulfide, cadmium sulfoselenide and mixtures thereof. Typical organic photoconductors include but are not limited to triphenyl-amine; 2,4-bis(4,4'diethyl aminophenyl)-1,3,4-oxadiazol; N-isopropylcarbazole triphenylpyrrol; 4,5-diphenyl-imidazolidinone; 4,5-diphenyl-imidazolidine thione; 4,-5-bis-(4'amino-phenyl)-imidazolidinone; 1,5-dicyanonahthalenel 1,4-dicyanonaphthalene; aminophthalodinitrile; nitrophthalodinitrile; 1,2,5,6-tetraaza-N-isopropylcarbazole triphenylpyrrol; 4,5-diphenylimidazolidinone; 4,5-diphenylimidazolidinethione; 4-5-bis-(4'-amino-phenyl)-imidazolidione; 1,5-dicyanonaphthalene; 1,4-dicyanonaphthalene; 1,4-dicyanonaphthalene; aminophthalodinitrile; nitro phthalodinitrile; 1,2,5,6-tetraazacyclooctatetranene-(2,4,6,8); 2-mercaptobenzathiazole; 2-phenyl-4-diphenylidene-oxazolone; 6-hydroxy-2,3-di(p-methoxyphenyl)-benzofurane; 4-dimethyl-aminobenzylidene-benzhydrazide; 3-benzylidene-amino-carbazole; polyvinyl carbazole; (2-nitrobenzylidene)p-bromo-aniline; 2,3-diphenyl quinazoline; 1,2,4-triazine; 1,5-diphenyl-3methylpyrazoline; 2-(4'-dimethylaminophenyl)-benzoxazole; 3-aminocarbazole; phthalocyanines; trinitrofluoronone polyvinyl carbazole; charge transfer complexes and mixtures thereof.

Any suitable method of charging may be employed in the system of the present invention. Typical charging methods include corona, charge deposition resulting from air breakdown in the gap commonly referred to as TESI, or charging in vacuum with an electron gun.

Any suitable method of exposure may be employed in the system of the present invention. Typical methods of exposure include: reflex, contact, holographic techniques, non-lens slit scanning systems, and optical projection systems involving lens imaging of opaque reflective subjects as well as transparent film originals.

Any suitable method of development may be employed in the system of the present invention. Typical development systems include: cascade development, magnetic brush development, and the like.

Any suitable method of fixing may be employed in the process of the present invention. Typical methods of fixing include: heat-pressure fusing, combination radiant, conductive and convection fusing, such as oven fusing, cold pressure fixing, solvent fusing, and a combination of heat, pressure solvent fusing.

The above mentioned developers were found to perform exceptionally well when used for the production of color xerographic prints from an original. There was no degradation of the triboelectric properties of the developer, nor unacceptable imaging due to impaction, and other problems associated with prior art developers. In one embodiment the developer of the present invention is provided from a developer housing in an automatic color electrophotographic imaging machine. A photoconductive member is then charged, selectively exposed to light of the primary colors, or one of the primary colors, developed with the developer of the present invention, transferred to a suitable substrate, such as paper, and then fused.

The developers of the present invention are especially useful in flat color copying systems. The term flat color is well known in the art, thus for example in the printing industry, flat color copying is accomplished by effecting multiple passes of the output print, through a printing press. Each pass of the print results in the production of a different color. Gradations of value or darkness, and chroma, or saturation are obtained by halftoning techiques, however, gradations of hue during a single pass does not result. Accordingly, the colors on the output print are usually of a uniform shade, and of a uniform darkness, and the number of hues represent the number of passes, by the output document through the press.

The invention will now be described in detail with respect to specific preferred embodiments thereof, it being understood that these examples are intended to be illustrative only and the invention is not intended to be limited to the materials, conditions, process parameters, etc. recited herein. All parts and percentages are by weight unless otherwise indicated.

EXAMPLE 1

There was prepared a brownish colored toner blend by mixing together at toom temperature 2 parts by weight of the magenta toner material, 2,9-dimethyl substituted quinacridone, 1 part per weight of the cyan toner material copper tetra-4-(octadecylsulfonomido)phthalocyanine, and 2 parts by weight of the yellow toner material diarylide yellow 3,3-dichlorobenzidene aceto acetanilide in a twin shell apparatus having a rotation rate of about 45 revolutions per minute the mixing being accomplished for a period of about ½ hours.

The magenta, cyan, and yellow toners are prepared by melt blending 90 parts by weight of a styrene-n-butyl methacrylate copolymer resin, (58/42) and 10 parts by weight respectively of, the magenta material, a 2,9-dimethyl substituted quinacridone, the cyan toner material copper tetra-4-(octadecylsulfonomido)phthalocyanine, and the yellow material, diarylide yellow 3,3-dichlorobenzidene aceto acetonilide.

The resultant brownish colored toner blend 97 parts by weight is mixed with 3 parts by weight of a steel carrier. The resultant developer is then employed in a commercial automatic xerographic machine apparatus, and excellent color copies of high resolution result after a single development sequence.

The developer produced can also be used in a magnetic brush developer system, which system is positioned around the selenium photoreceptor. The photoreceptor is charged to a positive potential of +100° volts, and exposed to an image. The latent electrostatic image formed on the photoreceptor is developed with the above developer by engaging the developer housing into development configuration with the photoreceptor. The image on the photoreceptor is then transferred to a receiver sheet in register. The photoreceptor is cleaned of the residual toner and is then ready for a subsequent exposure. The receiver sheet containing the cyan, magenta and yellow toner is the heat fused.

The above processes was repeated numerous times, and 75,000 color prints of good contrast, color, and quality were produced.

EXAMPLE II

The procedure of Example I was repeated with the exception that a yellow-green shade toner is produced by mixing together zero parts by weight of 2,9-dimethylquinacridone, 1 parts per weight of copper tetra-4-(octadecylsulfonomido)phthalocyanine and 7 parts by weight of the diaryldide yellow 3,3-dichlorobenzidone aceto acetanilide. A developer was prepared in accordance with Example I, with the exception that a nickel berry carrier was used in place of the steel carrier. When this developer was used in a commercial automatic xerographic color machine, or with the magnetic brush developer system of Example I, substantially similar results were obtained, that is, excellent color copies of high resolution after a single development sequence; and color prints of good contrast, color, and quality were produced when a magnetic brush developer system is used.

EXAMPLE III

The procedure of Example I is repeated with the exception that a green colored toner blend is prepared by mixing together zero parts per weight of 2,9-dimethylquinacridone, 1 part per weight of copper tetra-4-(octadecylsulfonomido)phthalocyanine and 2 parts by weight of diaryldide yellow 3,3-dichlorobenzidene aceto acetanilide. A developer material was prepared in accordance with Example II. Substantially similar results were obtained when the developer was used in a commercial automatic xerographic color machine, or with the magnetic brush developer system of Example I.

Other modifications of the present invention will occur to those skilled in the art upon a reading of the present disclosure. These are intended to be included within the scope of this invention.

What is claimed is:

1. A developer composition comprised of a blend of toner particles containing a styrene/n-butyl methacryalte copolymer rsin, and the cyan colorant copper tetra-4-(octadecylsulfonomido)phthalocyanine, a styrene/n-butyl methacrylate copolymer resin and the magenta colorant 2,9-dimethyl substituted quinacridone, a styrene/n-butyl methacrylate copolymer resin and the yellow colorant diaryldide 3,3-dichlorobenzidene aceto acetanilide, and an uncoated single steel carrier material.

2. A developer composition in accordance with claim 1 wherein from about 1 percent to about 20 percent by weight of colorant is present, and from about 80 percent to about 99 percent by weight of resin is present.

3. A developer composition in accordance with claim 2 wherein from 5 to 12 percent by weight of colorant is present, and from 88 percent to 95 percent by weight of resin is present.

4. A developer composition in accordance with claim 1 wherein one part by weight of cyan toner, and one part by weight of yellow toner is utilized, thereby resulting in a yellowish-green developer, the cyan and yellow toner materials being comprised of a resin, a cyan colorant, and a yellow colorant.

5. A developer composition in accordance with claim 1 wherein two parts by weight of cyan and one part by weight of yellow are present in the composition, thereby resulting in a blue-green developer.

6. A developer composition in accordance with claim 1 wherein three parts by weight of cyan, and one part by weight of magenta are present in the composition thereby resulting in a blue developer.

7. A method for producing colored images utilizing a single pass xerographic imaging system which comprises charging the photoreceptor contained in the imaging system, followed by imagewise exposure of said photoreceptor, which image is developed with the developer composition comprised of a blend of toner particles comprising a styrene/n-butyl methacryalte copolymer resin, and the cyan colorant copper tetra-4-(octadecylsulfonomido)phthalocyanine, a styrene/n-butyl methacrylate copolymer resin and the magenta colorant 2,9-dimethyl substituted quinacridone, a styrene/n-butyl methacrylate copolymer resin and the yellow colorant diaryldide 3,3-dichlorobenzidene aceto acetanilide, and an uncoated single steel carrier material.

8. A method in accordance with claim 7 wherein the resin is a styrene/n-butyl methacrylate copolymer, the cyan colorant is copper tetra-3-(octadecysulfonomido)phthalocyanine, the magenta colorant is a 2,9-dimethyl substituted quinacridone, the yellow colorant is a diaryldide yellow, 3,3-chlorobenzidene aceto acetanilide, and the carrier material is steel.

9. A method in accordance with claim 7 wherein from about 1 percent to about 20 percent by weight of colorant is present, and from about 80 percent to about 99 percent by weight of resin is present.

10. A method in accordance with claim 7 wherein from 5 to 12 percent by weight of colorant is present, and from 88 percent to 95 percent by weight of resin is present.

11. A method in accordance with claim 7 wherein three parts by weight of cyan, and one part by weight of magenta are present in the developer composition, thereby resulting in a blue toner.

* * * * *